US005232610A

United States Patent [19]

McLaughlin

[11] Patent Number: 5,232,610

[45] Date of Patent: Aug. 3, 1993

[54] MOLD ELEMENT CONSTRUCTION

[76] Inventor: Timothy M. McLaughlin, 2461 Warren Pkwy., Twinsburg, Ohio 44087

[21] Appl. No.: 408,145

[22] Filed: Sep. 15, 1989

[51] Int. Cl.[5] ..... B29C 33/00; B29C 33/38; B29C 33/48

[52] U.S. Cl. ..... 249/134; 164/522; 264/109

[58] Field of Search ..... 106/38.2, 38.22, 38.27, 106/38.9, 600, 623, 636, 635, 640, 643, 733, 769; 419/19, 23, 38, 57, 62-65; 249/80, 134, 135; 264/225, 109; 164/529, 409, 528, 522; 51/410; 241/DIG. 10

[56] References Cited

U.S. PATENT DOCUMENTS

| | | | |
|---|---|---|---|
| 205,598 | 7/1878 | Willis | 106/643 |
| 768,983 | 8/1904 | Dunn | 106/643 |
| 1,348,099 | 7/1920 | Ellis et al. | 106/643 |
| 1,587,621 | 6/1926 | Walther | 164/529 |
| 1,758,488 | 5/1930 | Weil | 106/38.9 |
| 1,829,746 | 11/1931 | Harrison | 106/643 |
| 2,381,735 | 8/1945 | Gantz | 106/38.9 |
| 2,488,252 | 11/1949 | Wood | 106/643 |
| 2,488,752 | 11/1949 | Wood | 585/465 |
| 2,570,827 | 10/1951 | Madison et al. | 106/1.27 |
| 2,702,425 | 2/1955 | Thompson | 106/38.9 |
| 2,887,392 | 5/1959 | Lolley et al. | 106/38.3 |
| 2,952,553 | 9/1960 | Illenda et al. | 106/38.3 |
| 2,987,406 | 6/1961 | Minnick | 106/38.27 |
| 3,008,200 | 11/1961 | Olsen | 22/57 |
| 3,053,713 | 9/1962 | Juras | 264/219 |
| 3,216,074 | 11/1965 | Harrison | 249/135 |
| 3,228,074 | 1/1966 | Rubel et al. | 22/193 |
| 3,407,864 | 10/1968 | Anderko et al. | 164/522 |
| 3,450,156 | 11/1970 | Stebbins ete al. | 51/423 |
| 3,605,855 | 9/1971 | Nakata | 249/135 |
| 4,086,952 | 5/1978 | Olsson | 164/485 |
| 4,255,193 | 3/1981 | Slesar et al. | 75/206 |
| 4,269,256 | 5/1981 | Nakazawa et al. | 106/38.2 |
| 4,283,015 | 8/1981 | Smith | 241/5 |
| 4,514,227 | 4/1985 | Szabo | 106/38.2 |
| 4,531,705 | 7/1985 | Nakawa et al. | 249/134 |
| 4,563,151 | 1/1986 | Vogel | 432/15 |
| 4,678,020 | 7/1987 | Hayes | 164/16 |
| 4,680,681 | 11/1984 | Alexander et al. | 164/522 |
| 4,769,075 | 9/1988 | Watanabe | 106/38.2 |
| 4,927,467 | 5/1990 | Kusakawa et al. | 148/3 |

FOREIGN PATENT DOCUMENTS

| | | | |
|---|---|---|---|
| 53-77832 | 7/1978 | Japan | 164/522 |
| 0081429 | 7/1978 | Japan | 164/522 |
| 54-146214 | 11/1979 | Japan | 164/529 |
| 0151507 | 11/1979 | Japan | 164/522 |
| 0181956 | 5/1989 | Japan | 164/529 |
| 2649601 | 5/1978 | Poland | 164/522 |
| 00555966 | 6/1977 | U.S.S.R. | 164/522 |
| 321394 | 10/1929 | United Kingdom | 432/15 |

OTHER PUBLICATIONS

Weast et al, Handbook of Chemistry and Physics CRC Press Inc., Boca Raton, Fla. (1984) pp. E-45 & D 186. Hawley, Condensed Chemical Dictionary 10 Ed. Van Nostrand/Reinhold, N.Y. (1977) p. 708 relied on.

*Primary Examiner*—Willard Hoag

*Attorney, Agent, or Firm*—Arnold B. Silverman; David V. Radack

[57] ABSTRACT

A mold element comprised of metallic pellets and a bonding agent to bond together the metallic pellets. The metallic pellets can be a mixture of ferrous shot and ferrous grit and the bonding agent can be a solvent or a resin. An associated method is also provided.

20 Claims, 2 Drawing Sheets

MOLD ELEMENT CONSTRUCTION

BACKGROUND OF THE INVENTION

1. Field of the Invention

The present invention relates to a mold element having a plurality of metallic elements secured to each other by means of a bonding agent, and a related method.

2. Brief Description of the Prior Art

It is well known to provide molds for casting certain objects. These molds have a cavity which is formed therein to correspond substantially to the external shape of the casting to be cast. The cavity is adapted to be filled with casting material through a suitable pouring hole.

Many times there is a need to form internal passages in metal castings. In order to accomplish this a "core" or "cores" are placed in the mold. Mold cores are traditionally produced from loose, divided grains which are "bound" or "adhered" together in a manner such that a solid structure is fashioned. These materials afford dimensional and structural stability and resist the tendency to combust. See U.S. Pat. Nos. 3,008,200 and 3,228,074. Once the molten metal is poured around such a core structure and the metal again solidifies, the core must be removed in such a fashion that the internal passage is retained within the cast shape. The most wide-spread method of core removal is disintegration of the core by "knock-out" methods using vibration and/or shock and by impact blast cleaning through the use of a focused media stream.

Traditionally, mold and mold core materials have consisted of various silica grains, ceramic grains, clays, and the like, held in place by "binders" of numerous compositions, such as a phenolic resin. See U.S. Pat. No. 3,228,074. It has also been known to magnetize the core material See U.S. Pat. No. 3,008,200.

Use of metal-metal oxide compositions for various articles is known. See, for example, U.S. Pat. No. 4,255,193 and United Kingdom Patent No. 321,394.

There is a present demand for greater casting integrity and for improved casting density in thin cast sections. There remains therefore, a very real and substantial need for inexpensive molds and mold cores that may be provided in a range of sizes that retains a high degree of structural accuracy.

SUMMARY OF THE INVENTION

The present invention is directed to a "mold element" which is defined herein as a mold or a mold core. The mold element is comprised of metallic pellets and a bonding agent to bond the metallic pellets to each other. The pellets are preferably held together in a matrix of metallic oxides (i.e., ferriferrous oxide and hydroxide - "rust") produced by exposing the pellets to a wetting agent such as water or steam mixed with one of the following constituents: alcohol; acid; base or salt solution. The pellet wetting agent mixture is then exposed to an oxygen rich atmosphere. The pellets can also be held together in a matrix by a resin such as oil type binders, silicates and the like and mixtures thereof, and subsequently curing the pellets and the binder mixture or exposing the pellets and the binder mixture to a catalyzing or setting substance.

It is an object of the present invention to provide a mold element which can provide high integrity and thin wall castings.

It is a further object of the present invention, to provide a mold element that comprises a metal-oxide-metal (i.e., "rust") matrix.

It is a further object of the present invention to provide a mold element that comprises a (i.e., "rust") matrix.

It is another object of the present invention to provide a method of making the mold element.

It is an object of the present invention to provide a mold element which is economical to manufacture and use.

It is a further object of the present invention to provide a ferrous based core material that can be easily handled by factory automated robots which utilize magnets to handle certain pick-and-place tasks in foundries.

It is a further object of the present invention to provide a mold element that is composed of material having greater durability and service life than conventional silica sand core material.

These and other objects of the invention will be more fully understood from the following description of the invention on reference to the drawings appended hereto.

DESCRIPTION OF THE PREFERRED EMBODIMENTS

As used herein, the term "mold element" will refer to both mold cores and molds.

Figure 1:
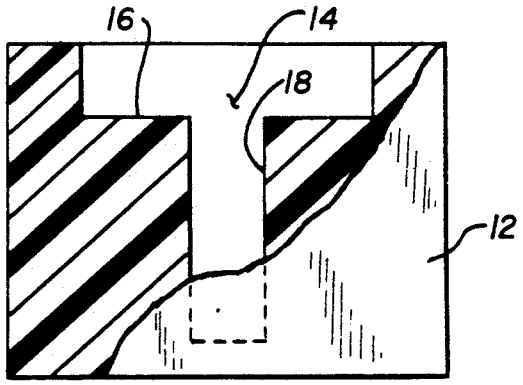
FIG. 1 is a partially cutaway side elevational view of the mold used to form the mold core of the invention.
Figure 2:
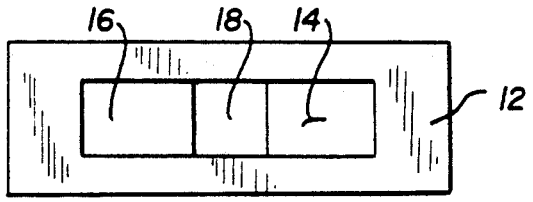
FIG. 2 is a top plan view of the mold of FIG. 1.

As used herein, the term "pellets" will refer to metallic elements, such as shot, grit, or products of abrasive blast cleaning. It is preferred that the metal media be composed of iron, steel, or mixtures thereof. Referring to FIGS. 1 and 2, the process of making the mold element of the invention will be explained. A mold 12 is provided which defines a recess 14 in the shape of the mold element to be produced. The recess 14 defined by the mold element is in the shape of a "T" having a horizontal portion 16 and a vertical square column 18. The horizontal portion 16 is preferably about 2 inches by 2 inches with a depth of about ½ inch. The vertical square column 18 is preferably about ½ inch by ½ inch and about 1½ inches long.

Figure 3:
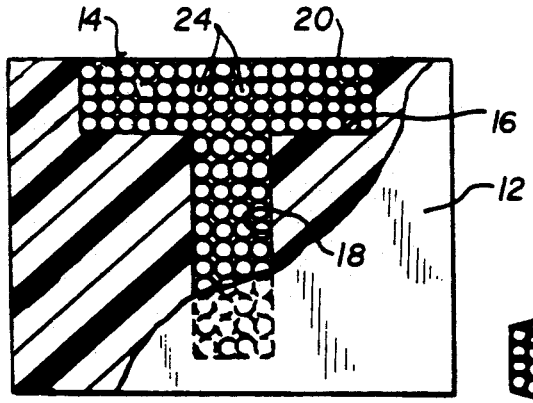
FIG. 3 is a partially cutaway side elevational view of the mold showing the formation of the mold core of the invention.

After providing the mold 12, the mold element 20 is formed by placing pellets 24 into the recess 14. The pellets 24 fill the recess 14 as is shown in FIG. 3. The pellets 24 will form the mold element 20 (here, a mold core) in the shape of a "T" as was described hereinabove.

After the pellets 24 are placed-into the recess of the mold 12, a solvent wetting agent is added to effect a metal-to-oxide-to metal binding (i.e., "rust") of the pellets 24. The rust will bind the mold element 20 for further use in the casting process, as will be described hereinbelow. It will be appreciated that the wetting agent insofar as the product of the invention is concerned will embrace any residual portions thereof which will remain in the final product as well as the oxides (i.e., "rust") established thereby. In place of a wetting agent, a resin binder or inorganic binder can be used to effect a metal-to-binder-to-metal binding. This will also be discussed hereinbelow.

The mold element 20 (which is still in the mold 12) is then preferably exposed to atmospheric air for about 36 to 48 hours at a temperature of about 70° F. with about 50% humidity. These conditions will allow the ferrous pellets to oxidize and bond when in the presence of a wetting agent for a metal-to-oxide-to-metal bond. If a resin is used (as will be discussed hereinbelow), varying times along with different catalysts may be required to form the mold element 20 to create the metal-to-binder-to-metal bond.

Figure 4:
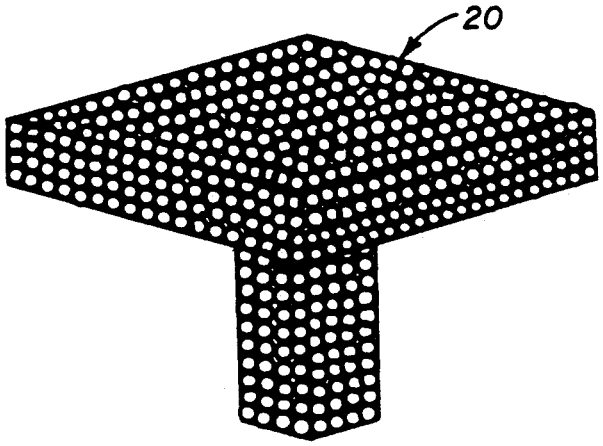
FIG. 4 is a perspective view of the finished mold core after it is removed from the mold.

The mold element 20 is preferably made of ferrous, round shot pellets with a "conditioned" surface. A "conditioned" surface is one which has loose layers introduced by impact fatigue and steel grit, being broken ferrous shot pellets possessing angular irregular shapes. Carbon steel shot in the range of SAE S-110 and carbon steel grit in the size range of SAE G-120 are the preferred sizes of ferrous pellets available commercially. The mold 12 must permit the mold element 20 to "set-up" while the matrix producing oxidation and resulting bonding (i.e., "rust") of the pellets 24 is taking place. The mold 12 should provide for easy release of the mold element 20 therefrom with all of the mold element 20 surfaces in tact and the mold element 20 rendered in one solid piece. This can be accomplished by using anti-stick procedures. Mold 12 can be coated with a very thin film (thickness 0.0025 inches) of petroleum jelly or can also have a lining of polytetrafluoroethylene (PTFE) to enhance the ejection of the mold element 20 from the core mold 12. FIG. 4 shows mold element 20 after being removed from the mold 12.

Figure 5:
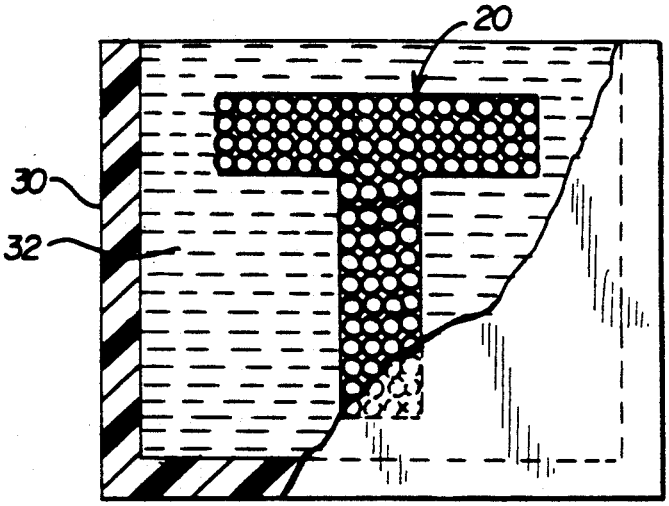
FIG. 5 is a partially cutaway side elevational view of a mold showing the mold and the molten metal placed therein.
Figure 6:
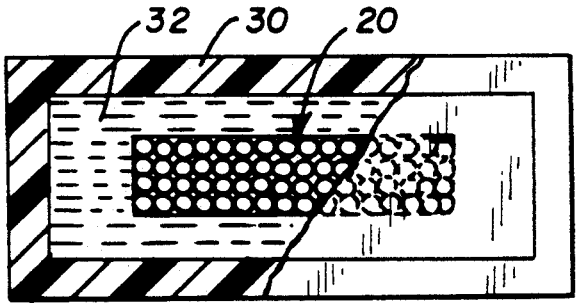
FIG. 6 is a partially cutaway top plan view of the mold of FIG. 5.

After ejection, the mold element 20 is placed into a mold 30 as is shown in FIGS. 5 and 6. Mold element 20 in this case is used as a mold core. Molten metal 32 is poured into the mold 30 and is formed around the mold element 20. This will create the desired internal passages in the cast metal shape.

After the molten metal 32 "chills", the mold element 20 is disintegrated by impact blast cleaning using a media stream directed at the mold element 20. Other methods, such as vibration and or shock can be used to remove the mold element 20 from the casting. The same shot and grit is used to impact blast clean the mold element 20. Thus, there is a saving of material in this process.

The size or range of sizes for the pellets 24 desired to be used for a given application and the surface composition and surface texture of the media are factors to be considered in the production of the mold element of the invention. In order to effect a metal-to-oxide-to-metal matrix, it is preferred to use a blend of 70% (by weight) SAE S-110 sized ferrous (steel) shot in combination with about 30% G-120 mesh sized ferrous (steel) grit. The shot can range from SAE S-70 to SAE S-110. The grit can range from G-120 through G-325. It will be appreciated that different combinations of different sized shot and grit can be used to accomplish desired properties for the mold element.

The preferred pellet blend described hereinabove provides a mold element composition which is sufficiently dense when solidified to provide mold element integrity and yet is easily disintegrated by steel abrasive impact blasting after solidification of the molten metal casting and when the mold element is desired to be removed from the mold. The approximate density of SAE S-110 is from about 0.440 to 0.450 kilograms per 100 cubic centimeters with about 0.445 kilograms per 100 cubic centimeters being preferred. The approximate density of SAE G-120-200 is from about 0.310 to 0.325 kilograms per 100 cubic centimeters with about 0.315 kilograms per 100 cubic centimeters being preferred. Density is especially important for mold cores in order to effect substantial structural integrity to resist the collapsing forces exerted on the mold core by the molten metal surrounding the mold core.

Sufficient density also provides a heat-sink substantial enough to promote high thermal energy transfer from the molten metal to the metal core which improves the metal microstructure and, thereby, improves the structural integrity of the solidified casting.

New ferrous shot may be used, however, it is preferred that "conditioned" ferrous shot be used as the metal media. "Conditioned" metal media are pellets which have been impacted prior to processing with the wetting agent. The surface qualities of conditioned media may be "flaky". The "flaking" surface of the conditioned pellet offers increased surface area for the formation of the metal binder, such as iron oxides. Conditioned grit can also be used, but this is not preferred in that the grit pellet has numerous vulnerable and poorly supported corners which will allow for significant attrition and resultant reduction in pellet mass.

The SAE S-110 shot pellets may be "conditioned" by impinging the round SAE S-110 pellets against the surface perpendicular to the direction from which they are being hurled. The pellet should be hurled and achieve impact while traveling at a rate of at least 200 feet per second. As used hereinafter, "conditioned shot" is intended to mean steel shot which has been impacted by the method described in the two preceding sentences of this paragraph, provided that the angle of impingement may be generally perpendicular and the speed of travel may be at least about 200 feet per second. The resulting impacting of the round metal pellet against the perpendicular surface causes the exterior surface or circumference of the pellet to "flake" or "scale" due to fatigue failure of the metal microstructure. The metal microstructure lattice is sheared along planes of least resistance to expedite this effect.

This composition also permits the transfer of more "miniscule"details from the core mold to the mold itself. The finely divided particle size of the core metal composition allows the reverse image of a core molding shape to be accomplished in fine detail. For example, a radiused region of a shape preferably as small as about 1/64 inch radius can be transferred from core mold to core structure.

Figure 7:
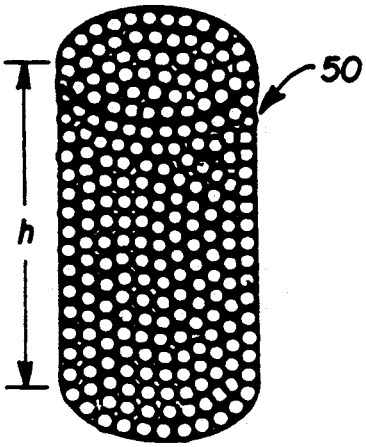
FIG. 7 is a perspective view of another shape of a mold core.
Figure 8:
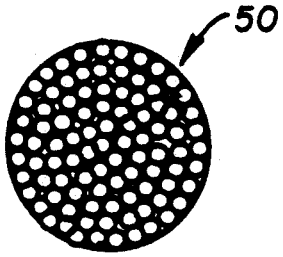
FIG. 8 is a top plan view of the mold core of FIG. 7.

It will be appreciated that other shapes of mold cores can be made. FIGS. 7 and 8 show a cylindrical mold core 50 having a diameter "d" of 1 7/32 inches and a height "h" of 1 29/32 inches. It will be appreciated that numerous other shapes, such as cones, truncated cones, spheres and the like can be produced.

The wetting agent used to bind the pellets is water or steam plus a constituent selected from the group consisting of an alcohol, an acid, a base and a salt. The alcohol can be selected from the group consisting of ethanol, methanol, isobutanol, and acetal. The acid can be selected from the group consisting of acetic acid, citric acid, nitric acid, and sulfuric acid. The base can be selected from the group consisting of ammonium hydroxide, calcium hydroxide, potassium hydroxide, and sodium hydroxide. The salt can be selected from the group consisting of saline, ammonium halide, calcium halide, potassium halide, and sodium halide. A preferred wetting agent, however, is a 4% concentration of acetic acid in water.

An alternative to using a wetting agent is to use a resin or inorganic binder. The resin or inorganic binder creates a binding matrix of metal-to-binder-to-metal as opposed to the metal-to-oxide-to-metal binding that is created by using a solvent wetting agent.

As for non-organic binders, a sodium silicate water based binder is preferred. Such a binder is sold under the trade designation "CHEM-BOND #14" by the Thiem Corporation. These types of binders cure as result of being exposed to carbon dioxide.

As for organic resins, a phenolic resin can be used. Such a resin is sold by the Borden Chemical Company under the trade designation "ALPHASET". In addition a furan resin, such as that sold under the trade designation "INSTADRAW 1000 FURAN BINDER" by Ashland Chemical Company can be used. Finally, a modified furan resin system, produced by adding phenol-formaldehyde polymers to furan polymers, can be used. Such a modified furan resin system is sold by the Ashland Chemical Company under the trade name "CHEM-REZ".

As is well known to those skilled in the art, certain catalysts, and modifiers, such as solvents, aromatics, and hydrocarbons, can be used to effect different properties of the resin. These different properties include curing time, bonding strength, resistance to humidity and breakdown of the resin at certain temperatures.

The solvent wetting agent may be added, poured, or injected into a stirred, homogeneous mixture of dry, ferrous, generally spherically shaped shot and grit. The amount of wetting agent required is about 5 to 15% of the dry ferrous media weight. These mixtures are placed in core mold receptacles and require a set-up time of approximately 36 hours before the core is removed from the receptacle.

The mold is preferably exposed to atmospheric air for about 36 to 48 hours at a temperature of about 70° F. with about 50% humidity. These conditions will allow the ferrous pellets to oxidize and bond when in the presence of a wetting agent for a metal-to-oxide-to-metal bond. A metal-to-binder-to-metal bond requires varying exposure times depending on the type of binder used.

When the core has dried sufficiently, the core is manually placed in the mold. Due to the sensitivity of the core it should be handled as few times as possible and, preferably ideally should be assembled or positioned within the mold.

When the molten alloy is poured around these cores in conjunction with a channel or passage allowing adequate access to the core, the core may readily be removed from the solidified casting yielding an internal passage. It is preferred that removal of the mold core is accomplished by impact blast cleaning using a media stream directed at the core. Alternatively, vibratory/-shock "knock-out" may also be used for core removal.

An advantage of the mold core of the present invention is that there are no highly combustible or gas producing elements present in the mold core composition. This further enhances the integrity of the cast product by reducing gaseous contamination of the molten metal due to the presence of combustion in the core.

EXAMPLE 1

A cylindrical core was produced using a 4% acetic acid solution to effect a metal-to-oxide-to-metal binding. About 103 grams of SAE S-110"conditioned" (flaked surface) steel shot was combined with about 44 grams of G-120/200 angular steel grit, and mixed by conventional methods and wetted with about 8.7 grams of 4% acetic acid solution.

The resulting "slurry" of steel/wetting agent was loaded and compacted using about 40 p.s.i. into a cylindrical core mold, fashioned from acrylic butadiene styrene plastic, measuring about 1 7/32 inches in diameter and 1 29/32 inches high.

The mixture was permitted to set for about 36 to 48 hours at about 70° F., and about 50% humidity at standard atmospheric conditions. The cylindrical ferrous composition was then removed and allowed to cure about an additional 12 to 24 hours in about 70° F., about 50% humidity, and standard atmospheric air. The resulting core was then suitable to be placed within casting mold to served as a mold core.

EXAMPLE 2

A conical core was produced employing about a 5% sodium silicate solution to effect a metal-to-binder-to-metal binding. About 70 grams of SAE S-110 "conditioned" spherical steel shot was blended with about 1.9 grams of a 5% sodium silicate solution.

The ferrous media/sodium silicate mixture was then poured into a conical core shape, fashioned from acrylic butadiene styrene plastic. The core measure dimensions had a bottom closed end with a 1 inch diameter; open end diameter of about 1 13/32 inches; and a height of about 7/8 inch with a 101° angle of taper. The ferrous pellet-sodium silicate binder composition was then permitted to air set. Also a highly concentrated $CO_2$ cure may be used for much shorter cure times. The ferrous core media/sodium silicate binder composition was then ejected from the core mold and was suitable for fitting in the core mold as a casting core.

It is appreciated that the mold core of the present invention is economical to produce and provides high integrity, thin wall alloy castings. The core is produced by addition of a wetting agent or a resin or inorganic binder to the metal pellets to the metal pellet to produce a metal-to-oxide-to-metal binder or a metal-to-binder-to-metal matrix, respectively.

It will be further appreciated that while reference has been made to iron or steel pellets, pellets of any metallic substance or combinations thereof may be used.

Whereas particular embodiments of the invention have been described above for purposes of illustration, it will be evident to those skilled in the art that numerous variations of the details may be made without departing from the invention as defined in the appended claims.

I claim:

1. A mold element for use in molding metal comprising:

a plurality of metallic pellets including at lease some conditioned ferrous shot which exhibits flakiness providing substantially increased surface area in comparison with such ferrous shot which has not been conditioned; and said metallic pellets being in a collapsible matrix.

2. The mold element of claim 1, wherein said metallic pellets are composed of a mixture of ferrous shot and ferrous grit.

3. The mold element of claim 2, wherein said mixture is about 70% by weight of said ferrous shot and about 30% by weight of said ferrous grit.

4. The mold element of claim 3, wherein said ferrous shot ranges in size from about SAE S-70 to SAE S-110.

5. The mold element of claim 4, wherein said ferrous grit ranges in size from about SAE G-120 to SAE G-325.

6. The mold element of claim 5, wherein said ferrous shot is about SAE S-110 in size.

7. The mold element of claim 6, wherein said ferrous grit is about SAE G-120 in size.

8. The mold element of claim 7, wherein said mold element is a mold core.

9. The mold element of claim 7, wherein said mold element is a mold.

10. The mold element of claim 1, wherein said bonding agent is a wetting agent, a resin or an inorganic binder.

11. The mold element of claim 10, wherein said wetting agent is a composition of water or steam and a constituent selected from the group consisting of an alcohol, an acid, a base, and a halide salt solution.

12. The mold element of claim 11, wherein said constituent is selected from the group consisting of ethanol, methanol, isobutanol, and acetal.

13. The mold element of claim 11, wherein said acid is selected from the group consisting of acetic acid, citric acid, nitric acid, and sulfuric acid.

14. The mold element of claim 11, wherein said base is selected from the group consisting of ammonium hydroxide, calcium hydroxide, potassium hydroxide, and sodium hydroxide.

15. The mold element of claim 11, wherein said halide salt solution is selected from the group consisting of ammonium halide, calcium halide, potassium halide, and sodium halide.

16. The mold element of claim 10, wherein said resin is a phenolic resin, a furan resin or a modified furan resin.

17. The mold element of claim 16, wherein said inorganic binder is sodium silicate.

18. The mold element of claim 16, wherein said resins are mixed with catalysts, whereby certain properties of said resins can be controlled.

19. The mold element of claim 1, wherein said mold element is a mold core.

20. The mold element of claim 1, wherein said mold element is a mold having a cavity.

* * * * *

UNITED STATES PATENT AND TRADEMARK OFFICE

CERTIFICATE OF CORRECTION

PATENT NO. : 5,232,610

DATED : August 3, 1993

INVENTOR(S) : TIMOTHY M. MCLAUGHLIN

It is certified that error appears in the above-identified patent and that said Letters Patent is hereby corrected as shown below:

Column 1, line 65, --,-- should be inserted after "silicates".

Column 2, line 8, --metal-binder-metal-- should be inserted after the second occurrence of "a".

Column 2, line 28, "FIG." should be deleted.

Column 2, line 29, --FIG.-- should be inserted before "1".

Column 3, line 3, "placed-into" should be --placed into--.

Column 3, line 4, "solvent" should be deleted.

Column 5, line 21, "solvent" should be deleted.

UNITED STATES PATENT AND TRADEMARK OFFICE

CERTIFICATE OF CORRECTION

PATENT NO. : 5,232,610

DATED : August 3, 1993

INVENTOR(S) : TIMOTHY M. MCLAUGHLIN

It is certified that error appears in the above-identified patent and that said Letters Patent is hereby corrected as shown below:

Column 5, line 44, "solvent" should be deleted.

Column 6, line 56, the second occurrence of "to the metal pellet" should be deleted.

Column 7, line 3, "lease" should be --least--.

Signed and Sealed this

Third Day of January, 1995

Bruce Lehman

*Attest:*

BRUCE LEHMAN

*Attesting Officer*

*Commissioner of Patents and Trademarks*